United States Patent [19]

Nakase et al.

[11] Patent Number: 4,773,883

[45] Date of Patent: Sep. 27, 1988

[54] MOTOR FOR WATERCRAFTS

[75] Inventors: Ryoichi Nakase; Masayoshi Nanami, both of Hamamatsu, Japan

[73] Assignee: Sanshin Kogyo Kabushiki Kaisha, Hamamatsu, Japan

[21] Appl. No.: 885,862

[22] Filed: Jul. 15, 1986

[30] Foreign Application Priority Data

Jul. 16, 1985 [JP] Japan ..... 60-156759

[51] Int. Cl.[4] ..... B63H 21/32; B63H 21/38

[52] U.S. Cl. ..... 440/88; 440/89; 114/270; 60/320; 60/322

[58] Field of Search ..... 440/88, 89; 114/270; 60/320–322, 314; 181/212, 221

[56] References Cited

U.S. PATENT DOCUMENTS

| | | | |
|---|---|---|---|
| 3,262,413 | 7/1966 | Douglas et al. | 440/89 |
| 3,462,947 | 8/1969 | Nowak | 60/314 |
| 3,798,904 | 3/1974 | Gleason et al. | 60/320 X |
| 3,827,392 | 8/1974 | Jones | 114/270 |
| 3,875,744 | 4/1975 | Brooks et al. | 60/314 X |
| 3,948,206 | 4/1976 | Tyler | 114/270 |
| 4,194,460 | 3/1980 | Sato et al. | 285/41 |
| 4,213,414 | 7/1980 | Sato et al. | 440/89 X |
| 4,506,749 | 3/1985 | Steven | 60/322 X |
| 4,678,442 | 7/1987 | Nishida et al. | 440/89 |
| 4,707,986 | 11/1987 | Takada et al. | 60/321 X |

FOREIGN PATENT DOCUMENTS

| | | | |
|---|---|---|---|
| 1305292 | 1/1973 | United Kingdom | 440/89 |

*Primary Examiner*—Sherman D. Basinger
*Attorney, Agent, or Firm*—Ernest A. Beutler

[57] ABSTRACT

Two embodiments of small watercraft incorporating an improved exhaust system for handling the exhaust gases from the engine. In each embodiment, at least one expansion chamber is provided for silencing and cooling the exhaust gases and exhaust gases are delivered from the engine exhaust port to the expansion chamber through a horizontally extending exhaust conduit that has its outlet opening communicating with the expansion chamber at a position spaced substantial distances from the vertically extending side and end walls of the expansion chamber for precluding the likelihood of entry of water into the engine cylinders through the exhaust system. In one embodiment, two such expansion chambers are employed.

21 Claims, 5 Drawing Sheets

MOTOR FOR WATERCRAFTS

BACKGROUND OF THE INVENTION

This invention relates to a motor for watercrafts and more particularly to an improved power unit and exhaust system therefor for a small watercraft powered by an inboard mounted engine.

There is a popular type of water vehicle that is intended to be driven primarily by a single driver and wherein the driver sits upon the watercraft and it is powered by an inboard mounted engine. In this type of watercraft, it is anticipated that the watercraft may tip over in use and, in fact, it is the normal practice for the driver to wear a swimming suit because of this possibility. This means that the power unit must be such that it will not be damaged by sudden maneuvering or upon tipping over.

This is particularly important in connection with the provision of the exhaust system for the engine. If the exhaust system is such that water may be drawn back into the engine through the exhaust system, severe damage to the engine might result. For this purpose, it has been proposed to provide a trap or gooseneck that connects the exhaust manifold with an expansion chamber. The expansion chamber is provided for engine exhaust cooling and silencing and the gooseneck is intended to insure against water passing back from the exhaust pipe to the engine cylinder if the boat becomes inverted. For this same reason, it has been the practice to use a forward disposed exhaust gas discharge so that the exhaust gases will be discharged from the watercraft in a generally forward location. This means that the exhaust gases must pass in a forward direction and generally along the side of the engine from the gooseneck to the area where the expansion chamber is positioned. As a result of the side by side placement of the engine and expansion chamber, the entire power unit becomes quite wide and this necessitates a widthening of the hull of the watercraft which is, of course, undesirable.

It is, therefore, a principal object of this invention to provide an improved power unit for a watercraft and more particularly to an improved high efficiency and compact exhaust system for such a watercraft.

It is a further object of this invention to provide an improved exhaust system for an inboard engine for a watercraft wherein a gooseneck and expansion chamber are incorporated so as to insure against the entry of water into the engine cylinders and which, at the same time, provides an improved and compact arrangement for the watercraft.

It is a further object of this invention to provide a power unit for a watercraft wherein the expansion chamber is located over the cylinder block and clear of the spark plugs so as to provide a larger volume expansion chamber and a compact power unit.

In connection with marine inboard engines, it is a normal practice to discharge the cooling water from the cooling jacket of the engine into the exhaust gases. With watercraft of the type heretofore described, it has been the practice to introduce this cooling water into the expansion chamber so as to cool the exhaust gases and the expansion chamber. However, the prior art methods and constructions wherein the cooling water is delivered into the expansion chamber further aggravates the likelihood of the return of water to the engine cylinders during extreme rolling operation or upon acceleration or deceleration.

It is, therefore, a still further object of this invention to provide an exhaust system for an inboard driven watercraft wherein water is precluded from re-entry into the cylinders even though it may accumulate in the exhaust expansion chamber.

SUMMARY OF THE INVENTION

A first feature of this invention is adapted to be embodied in a small watercraft powered by an inboard mounted engine comprised of a cylinder block comprising at least one generally vertically disposed cylinder. A cylinder head is affixed to the cylinder block and closes its cylinder. An exhaust passage is provided for discharge of the exhaust gases from the engine and an expansion chamber runs along a substantial portion of the length of the engine and is positioned at least in part above the cylinder head. Means are provided for delivering exhaust gases from the exhaust passage to the expansion chamber and means are provided for discharging the exhaust gases from the expansion chamber to the atmosphere.

Another feature of this invention is also adapted to be embodied in a small watercraft powered by an inboard mounted engine comprising an exhaust system for the engine that includes an exhaust pipe that receives exhaust gases from the engine exhaust port. An expansion chamber is provided and the exhaust pipe extends into the expansion chamber and has an outlet end which opens into the expansion chamber. The expansion chamber is further provided with an atmopsheric discharge for delivering the exhaust gases from the expansion chamber to the atmosphere. In accordance with this feature of the invention, the exhaust pipe outlet is spaced from the vertical side walls of the expansion chamber so that water contained within the expansion chamber cannot flow back into the exhaust pipe during sudden maneuvering.

DETAILED DESCRIPTION OF THE PREFERRED EMBODIMENTS

Figure 1:
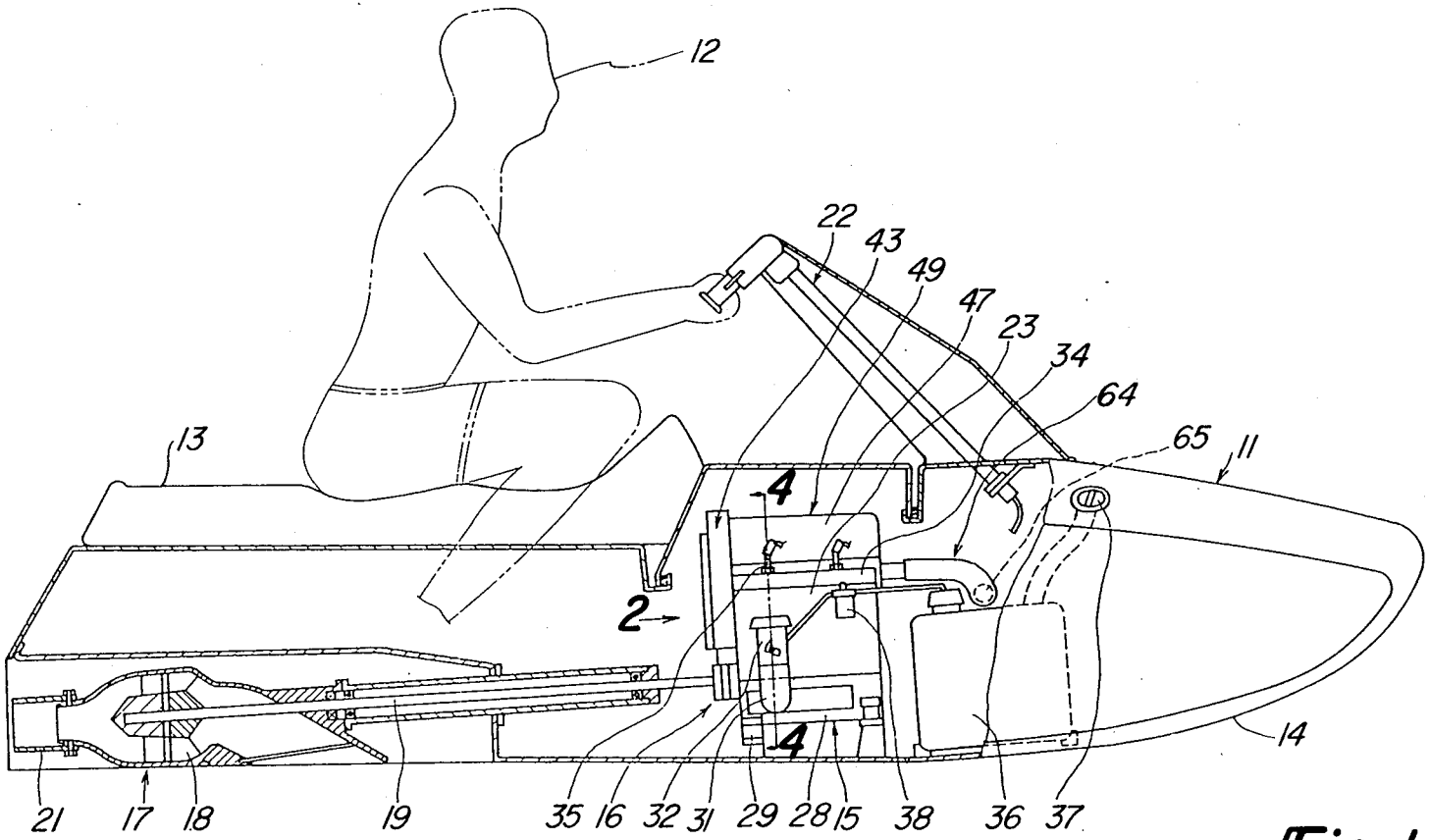
FIG. 1 is a side elevational view, with portions broken away and shown in section, of a small watercraft constructed in accordance with a first embodiment of the invention.

Referring now in detail to the drawings, a small watercraft constructed in accordance with a first embodiment of the invention is identified generally by the reference numeral 11. The watercraft 11 is of the type that is intended to be ridden by a single rider, shown in phantom and identified by the reference numeral 12, that is seated in straddle fashion on a seat 13 carried rearwardly on the hull 14 of the watercraft. The watercraft 11 is of the jet powered type and has an inboard mounted internal combustion engine, indicated generaly by the reference numeral 15, which has its output shaft connected by means of a coupling 16 to a jet drive unit, indicated generally by the reference numeral 17. The jet drive unit 17 is positioned rearwardly and beneath the seat 13 and includes an impeller 18 that is driven by an elongated drive shaft 19 that is connected to the engine output shaft by the coupling 16. The jet propulsion unit 17 has a pivoted discharge nozzle 21 which may be steered, as is well known in this art, for changing the direction of travel of the watercraft 11. A steering column or steering shaft 22 is supported forwardly of the seat 13 for accomplishing this steering.

Figure 4:
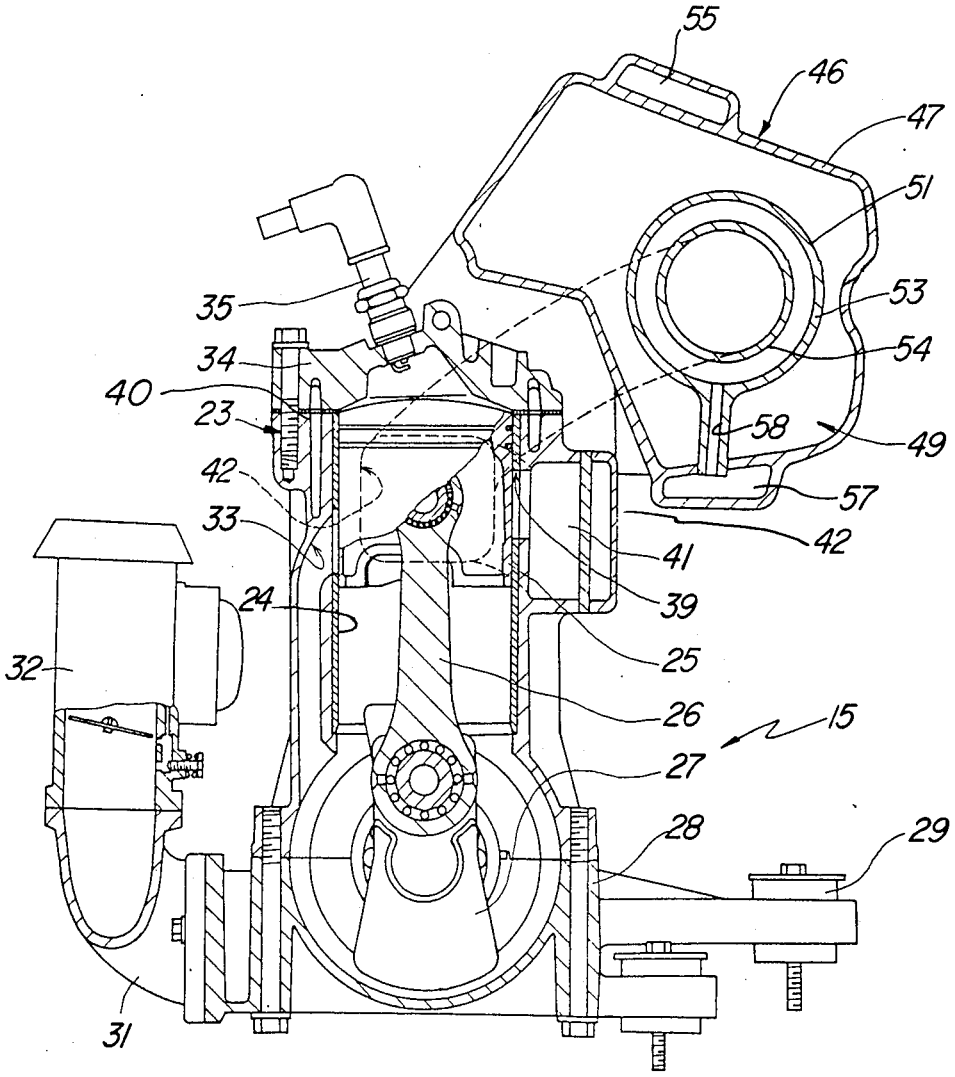
FIG. 4 is an enlarged cross sectional view taken along the line 4—4 in FIG. 1.

The engine 15 is, in the illustrated embodiment, of the two cylinder, two-cycle, inline type although it is to be understood that the invention may be equally as well practiced with other types of engines. The engine 15 includes a cylinder block 23 in which verticaly disposed cylinder bores 24 (FIG. 4) are formed. Pistons 25 reciprocate in the cylinder bores 24 and are connected by means of connecting rods 26 to a crankshaft 27 for driving it. The crankshaft 27 is journaled within a crankcase chamber formed by the cylinder block 23 and by a crankcase portion 28 that is affixed to the cylinder block 23 in a known manner.

The engine 15 is supported within the hull 14 of the watercraft by means of a mounting system that includes a plurality of elastomeric supports 29 that are engaged between flanges formed on the crankcase 28 and a suitable supporting element of the watercraft 11.

Because the engine 15 is of the two-cycle type, the individual chambers of the crankcase associated with each of the cylinder bores 24 are suitably sealed from each other. A fuel/air mixture is delivered to each of these sealed chambers from an intake manifold 31. The intake manifold 31, in turn, receives the fuel/air charge from a suitable charge forming device such as a carburetor 32 in a known manner. The fuel/air charge is compressed within the individual crankcase chambers by the reciprocation of the pistons 25 and is transferred to the area above the pistons 25 through suitable intake or scavenge passages 33.

A cylinder head 34 is affixed, in a suitable manner, to the cylinder block 23 and carries individual spark plugs 35 that are associated with each of the cylinder bores 24 for firing the charge therein at an appropriate time. The spark plugs 35 are fired by means of a suitable ignition system (not shown).

A fuel tank 36 is carried within the hull 14 forwardly of the engine 15 and has an externally accessible filler neck 37. The fuel tank 36 supplies fuel to the engine through a fuel line and fuel pump 38 which is, in turn, driven by the engine for delivering the fuel to the carburetor 32 in a known manner.

Exhaust gases from the individual cylinder bores 34 are discharged through exhaust ports 39 which are formed in the cylinder block 23 and which communicate with a longitudinally extending exhaust manifold 41 formed in part by the cylinder block 23 and which is provided with a water jacket 40 that receives the engine coolant for cooling and silencing the exhaust gases. The exhaust manifold 41 terminates in a rearwardly directed exhaust gas outlet 42 that is formed in a rear face of the cylinder block 23.

The exhaust gases flow from the exhaust manifold outlet 42 through a curved and upwardly extending exhaust gas conduit 43. The exhaust gas conduit 43 is formed by a pair of cover plates 44 and 45 that are affixed to the rear face of the cylinder block 23. In addition, a portion of the cover plate 44 also abuts the rear face of the cylinder head 34. The arcuate and upwardly extending shape of the exhaust conduit 43 functions like a trap so as to assist in insuring that water may now flow back into the engine cylinder bores 24 through the exhaust system.

Figure 2:
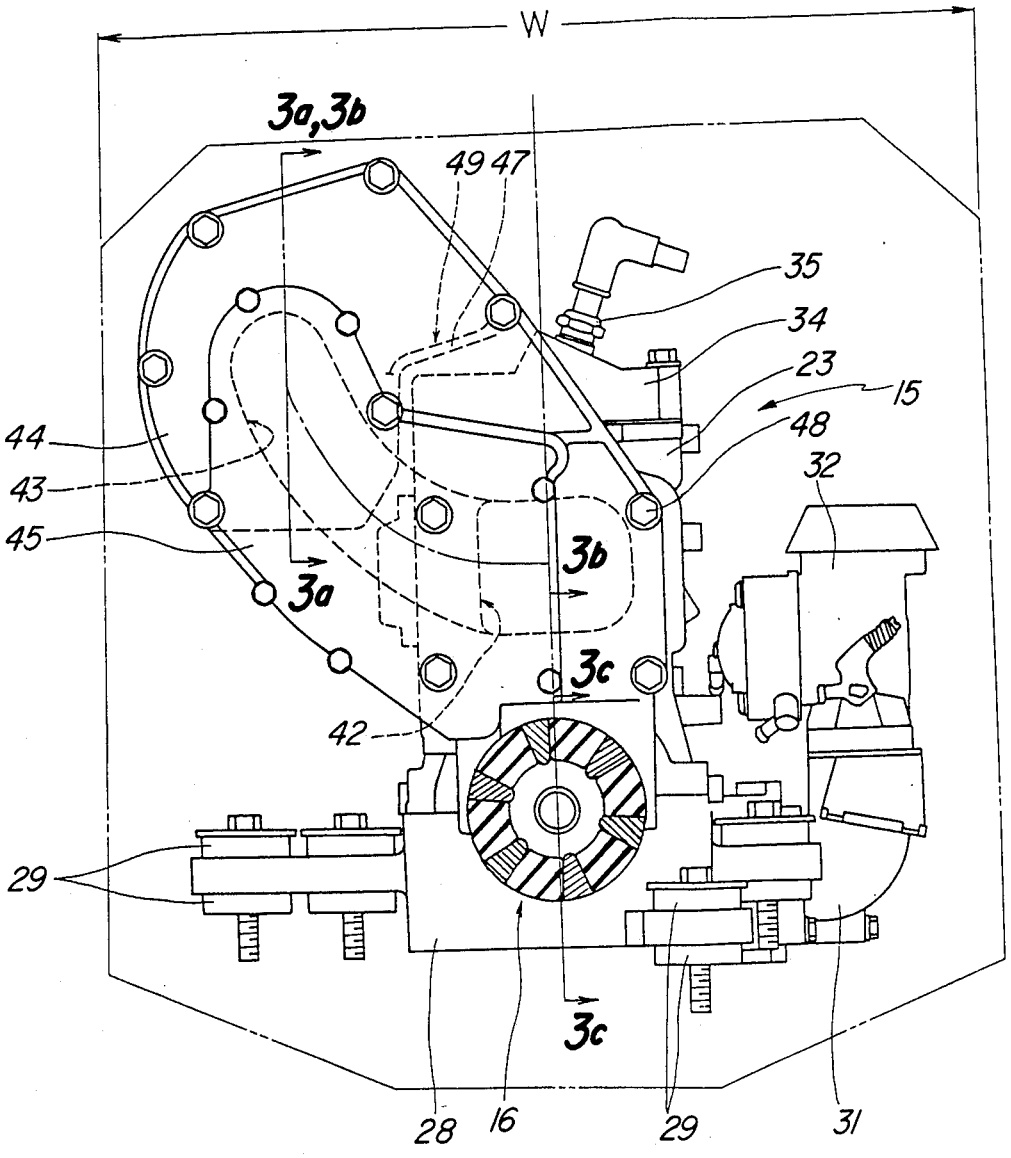
FIG. 2 is an enlarged rear elevational view of the power unit of the watercraft, taken in the direction of the arrow 2 in FIG. 1.
Figure 3:
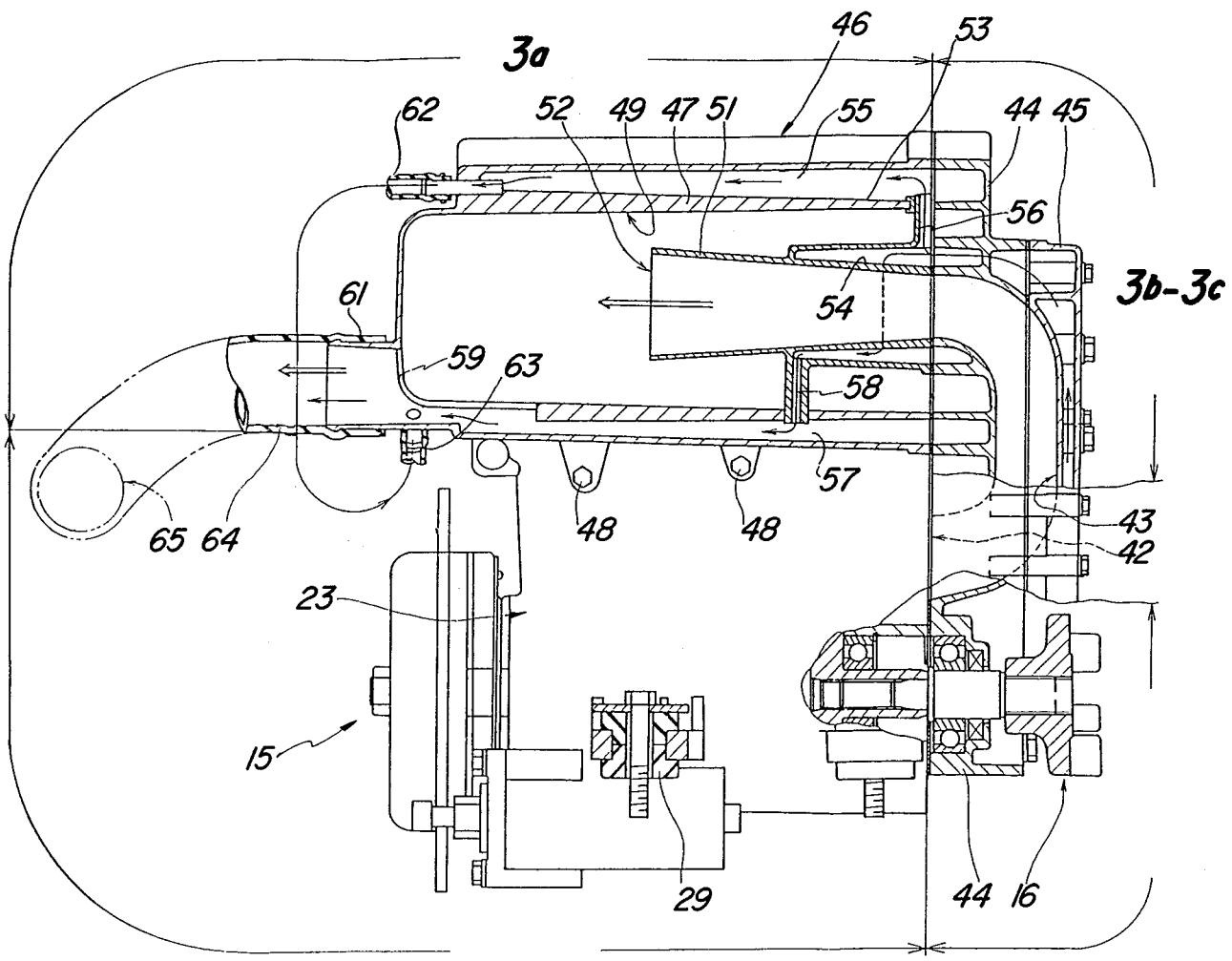
FIG. 3 is a composite, cross-sectional, side elevational view taken along the line 3*a*—3*a* and 3*b*—3*c* in FIG. 2.

The exhaust gases are delivered by the exhaust conduit 43 to a silencing device in the from of a first expansion chamber, indicated generally by the reference numeral 46. It should be noted that it is desirable to maintain a narrow width W (FIG. 2) for the hull 14 of the watercraft so as to minimize the resistance and maximize the performance. In accordance with the invention, the expansion chamber device 46 extends along the length of the engine 15 and overlies at least in part the cylinder head 34 so as to achieve such a compact configuration. Although the expansion chamber 46 overlies the cylinder head 34, it is clear of the area where the spark plugs 35 are positioned so as to facilitate servicing.

The expansion chamber device 46 is comprised of a main housing assembly 47 that is affixed to the cylinder block and cylinder head by means of threaded fasteners or bolts 48. The housing 47 defines an enlarged expansion chamber 49 that extends along the length of the engine and which also overlies in part the cylinder head 34. Because of this, a very large expansion chamber can be utilized which effectively aids in the silencing of the exhaust gases. The exhaust gases are discharged into the expansion chamber through a megaphone section 51 that is formed by the housing 47 and which communicates with the discharge end of the exhaust conduit 43. It should be noted that the megaphone section 51 extends in a generally horizontal direction and has its discharge opening 52 formed in substantially the longitudinal center of the expansion chamber 49 so that it is spaced from the vertically extending side and end walls of the expansion chamber 49. This is a very important for a reason to be described.

The housing 47 and the housing 46 define an outer wall portion 53 that encircles the inlet portion of the megaphone section 51 and the outlet portion of the exhaust conduit 43. A cooling jacket 54 is thereby formed around these exhaust conduits and coolant from the engine cooling system is delivered to this cooling jacket 54 for providing cooling of the exhaust gases. The coolant is discharged from the cooling jacket 54 upwardly into a first longitudinally extending cooling jacket 55 that extends along the upper side of the expansion chamber 49 through a discharge pipe 56. In addition, there is a horizontally extending lower cooling jacket 57 to which coolant is discharged from the cooling jacket 54 through a second discharge conduit 58. Hence, there will be cooling of the exhaust gases in the expansion chamber 49 which further assists in the silencing and cools the exhaust gases to a temperature whereby they may be easily and conveniently controlled.

The forward lower end of the expansion chamber 49 is formed with an exhaust outlet opening 59 that cooperates with an exhaust gas outlet 61 formed by the housing 47 at the lower forward end of the expansion chamber 49. The exhaust gases thus may discharge from the expansion device 46 through this outlet opening 61.

The coolant from the cooling jackets 55 and 57 is also discharged through the exhaust outlet 61. The cooling jacket 57 communicates directly with the outlet 61 at its downstream end. A flexible conduit 62 connects the outlet of the cooling jacket 55 with a nipple 63 formed in the exhaust outlet 61. The coolant will have been heated and will generally be discharged in the form of steam at the outlet 61. In addition, if this coolant ends to flow back into the expansion chamber 49 during said movements of the watercraft 11 or due to its inversion, this water will not be sloshed back into the megaphone outlet 52 since this outlet is, as has been noted, spaced from the vertically extending side and end walls of the expansion chamber 49. With prior art type of devices the discharge of exhaust gases are into the chamber of the watercraft has tended to cause the coolant to be delivered back into the engine cylinders through the system. The megaphone section 51 extends horizontally and because its outlet opening 52 is spaced from the side walls of the expansion chamber 49, the likelihood of returning to the engine through the exhaust system is substantially reduced. For the same reason water from the body in which the watercraft 11 is operating also will be precluded from entering into the engine cylinders. A flexible conduit such as a hose 64 is connected to the expansion chamber exhaust gas outlet 61 and extends, in this embodiment, to a sidewardly directed exhaust gas outlet 65 formed in the hull 14. Because the exhaust gases have been cooled through the expansion and through their contact with the coolant of the engine 15, such a flexible hose 64 may be utilized for handling the exhaust gases.

Figure 5:
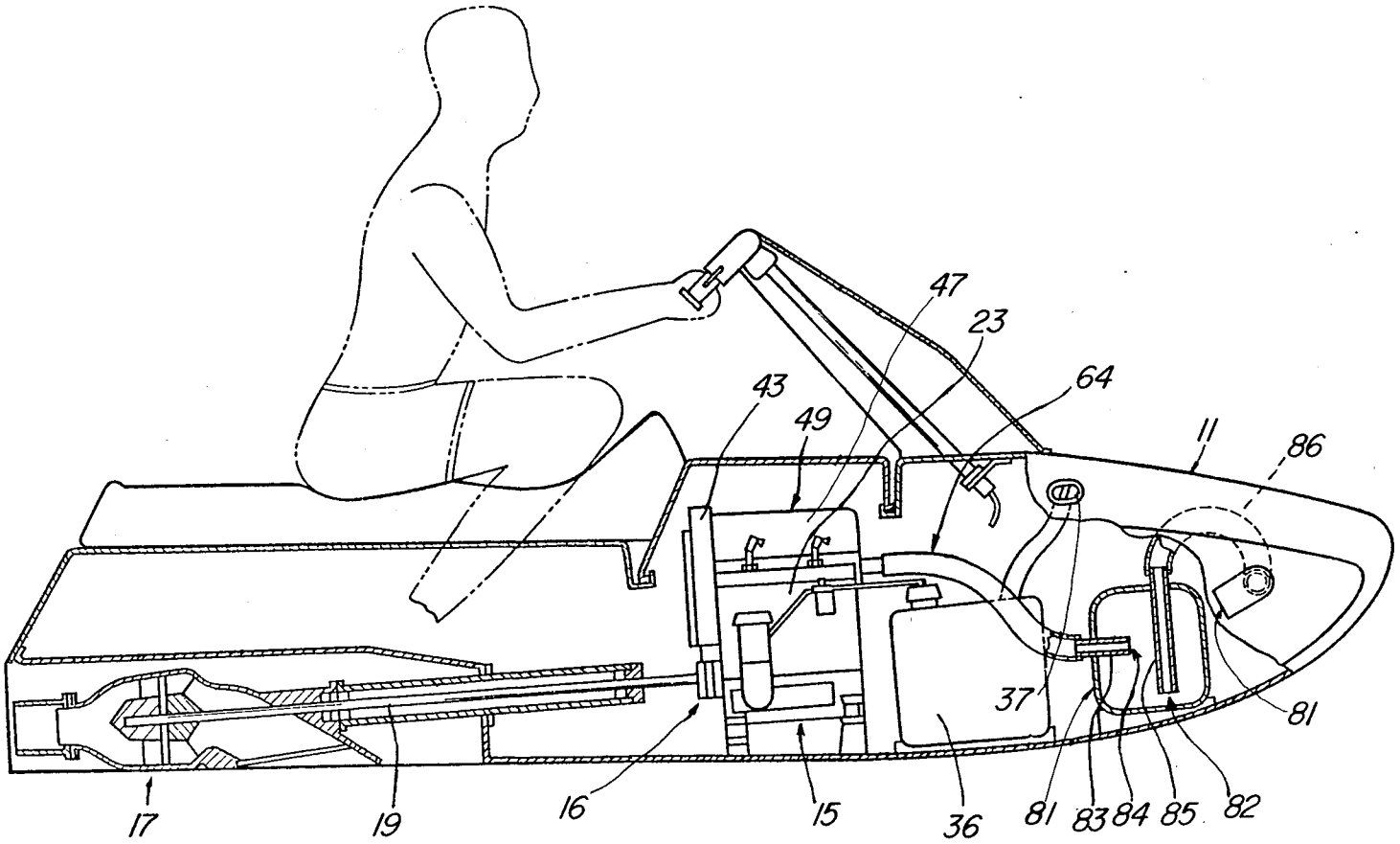
FIG. 5 is a side elevational view, with portions broken away and shown in section, in part similar to FIG. 1, of another embodiment of the invention.

FIG. 5 illustrates another embodiment of the invention which is generally similar to the embodiment of FIGS. 1 through 4. For that reason, those components which are identical to the previously described components have been identified by the same reference numerals and will not be described again in detail.

In this embodiment, the flexible conduit 64 delivers the exhaust gases to a second expansion chamber device, indicated generally by the reference numeral 81. The expansion chamber device 81 includes an outer housing that is mounted in the hull 14 forwardly of the fuel tank 36 and which has an internal expansion chamber 82. Exhaust gases are delivered to the expansion chamber 82 through an exhaust pipe 83 that communicates at its inlet end with the flexible conduit 64. The exhaust pipe 83 has an outlet end 84 that is disposed centrally of the expansion chamber 82 and which is spaced a substantial distance from its vertical side walls so that water is not likely to re-enter the exhaust system through the outlet 84 regardless of extreme maneuvering of the watercraft 11 or its inversion. Also, for the same reason, the exhaust pipe 84 extends in a horizontal direction longitudinally of the watercraft 11 in the same manner as the megaphone 51 of the expansion chamber device 46.

An exhaust outlet pipe 85 extends vertically into the expansion chamber 82 and cooperates with a flexible hose 86 for delivering exhaust gases to the atmosphere through a hull mounted exhaust discharge pipe 87.

It should be readily apparent from the foregoing description that two embodiments of the invention have been illustrated, each of which provides effective silencing of the exhaust gases of a small watercraft while at the same time precluding the likelihood of re-entry of water, either from the engine cooling system or from the body of water in which the watercraft operates, back into the cylinders through the exhaust system. In addition, very effective silencing and cooling of the exhaust gases is provided. Although two embodiments of the invention have been illustrated and described, it should be readily apparent that the invention may be practiced in other forms and such variations will be readily apparent to those skilled in the art and are deemed to come within the spirit and scope of the invention, as defined by the appended claims.

We claim:

1. A small watercraft propelled by an inboard mounted engine comprised of a cylinder block comprising at least one cylinder, a cylinder head affixed to said cylinder block and closing said cylinder, an exhaust passage for discharging exhaust gases from said engine, an expansion chamber extending along a substantial portion of the length of said engine and positioned at least in part above said cylinder head, means comprising an exhaust pipe extending from said exhaust passage and discharging in a horizontal direction into said expansion chamber for delivering exhaust gases from said exhaust passage to said expansion chamber, and means opening through a lower wall of said expansion chamber for discharging exhaust gases from said expansion chamber to the atmosphere.

2. A small watercraft as set forth in claim 1 wherein the cylinder is vertically disposed.

3. A small watercraft as set forth in claim 1 wherein the exhaust gaess are delivered from the exhaust passage to the expansion chamber at one end of the engine and the means for discharging the exhaust gases from the expansion chamber is located at the other end of the engine.

4. A small watercraft as set forth in claim 3 wherein the means for discharging the exhaust gases from the expansion chamber is positioned at the forward end of the engine.

5. A small watercraft as set forth in claim 4 wherein the means for delivering the exhaust gases from the exhaust passage to the expansion chamber includes a trap for precluding the entry of water into the engine through the exhaust system.

6. A small watercraft as set forth in claim 5 wherein the cylinder is vertically disposed.

7. A small watercraft as set forth in claim 5 wherein the exhaust pipe terminates in a megaphone section extending into the expansion chamber.

8. A small watercraft as set forth in claim 3 wherein the exhaust pipe terminates in a megaphone section extending into the expansion chamber.

9. A small watercraft as set forth in claim 1 further including a cooling jacket adapted to receive engine coolant and extending along the periphery of the expansion chamber.

10. A small watercraft as set forth in claim 9 further including means defining a cooling jacket surrounding the means for delivering exhaust gases from the exhaust passage to the expansion chamber.

11. A small watercraft as set forth in claim 10 wherein the exhaust pipe terminates in a megaphone section extending into the expansion chamber.

12. A small watercraft as set forth in claim 10 further including means for discharging coolant from the cooling jacket into the means for discharging the exhaust gases from the expansion chamber to the atmosphere.

13. A small watercraft as set forth in claim 12 wherein the exhaust gases are delivered from the exhaust passage to the expansion chamber at one end of the engine and the means for discharging the exhaust gases from the expansion chamber is located at the other end of the engine.

14. A small watercraft as set forth in claim 13 wherein the means for discharging the exhaust gases from the expansion chamber is positioned at the forward end of the engine.

15. A small watercraft as set forth in claim 14 wherein the cylinder is vertically disposed.

16. A small watercraft as set forth in claim 15 wherein the means for delivering the exhaust gases from the exhaust passage to the expansion chamber includes a trap for precluding the entry of water into the engine through the exhaust system.

17. A small watercraft as set forth in claim 1 wherein the expansion chamber is defined at least in part by vertically extending side walls and the exhaust pipe has its outlet positioned a substantial distance from said vertically extending side walls of the expansion chamber.

18. A small watercraft as set forth in claim 1 wherein the means for discharging the exhaust gases to the atmosphere fro mthe expansion chamber includes a second expansion chamber into which the exhaust gases are delivered.

19. A small watercraft as set forth in claim 18 wherein the exhaust gases are delivered into each of the expansion chambers by a horizontally extending exhaust conduit that opens into each expansion chamber at a substantial distance from its vertically extending side walls.

20. A small watercraft as set forth in claim 1 wherein the expansion chamber is defined at least in part by vertically extending side walls and the exhaust pipe outlet is positioned a substantial distance from said vertically extending side walls of said expansion chamber, said exhaust pipe outlet being directed longitudinally of the watercraft.

21. A small watercraft as set forth in claim 20 wherein the exhaust pipe extends horizontally.

* * * * *